US005489754A

United States Patent [19]

Dirmeyer et al.

[11] Patent Number: 5,489,754

[45] Date of Patent: Feb. 6, 1996

[54] HOUSING SECTION FOR AN ELECTRIC CIRCUIT TO BE PROTECTED FROM HARMFUL SUBSTANCES, E.G. A MOTOR VEHICLE LOCKING SYSTEM, AND PROCESS FOR PRODUCING A HOUSING WITH THE HOUSING SECTION

[75] Inventors: Josef Dirmeyer, Bodenwöhr; Klaus Mayer, Regensburg; Josef Gleixner, Nabburg, all of Germany

[73] Assignee: Siemens Aktiengesellschaft, Munich, Germany

[21] Appl. No.: 198,622

[22] Filed: Feb. 18, 1994

[30] Foreign Application Priority Data

Aug. 29, 1991 [DE] Germany ..... 41 28 778.9

[51] Int. Cl.[6] ..... H01H 9/04

[52] U.S. Cl. ..... 200/302.1; 200/512; 200/302.2

[58] Field of Search ..... 200/302.1, 302.2, 200/511, 301, 302.3, 512, 513, 514, 515, 516

[56] References Cited

U.S. PATENT DOCUMENTS

| | | | |
|---|---|---|---|
| 4,170,104 | 10/1979 | Yamagata | 200/512 |
| 4,463,232 | 7/1984 | Takakuwa | 200/5 A |
| 4,490,587 | 12/1984 | Miller et al. | 200/5 A |
| 4,560,844 | 12/1985 | Takamura et al. | 200/5 A |
| 5,181,603 | 1/1993 | Mori et al. | 200/302.1 |

FOREIGN PATENT DOCUMENTS

| | | |
|---|---|---|
| 874961 | 6/1984 | Austria . |
| 2912049 | 10/1979 | Germany . |
| 2144271 | 2/1985 | United Kingdom . |

*Primary Examiner*—Henry J. Recla
*Assistant Examiner*—David J. Walczak
*Attorney, Agent, or Firm*—Herbert L. Lerner; Laurence A. Greenberg

[57] ABSTRACT

A housing includes a housing section made of hard thermoplastic material for a circuit, e.g. a motor vehicle locking system, to be protected from harmful substances, and at least one pressure member being made of soft thermoplastic material and being accessible from outside the housing. Each pressure member serves to operate at least one electric switch being disposed or to be disposed inside the housing. Edges of the pressure member provide an all-round watertight and adhesive-free cover for a hole in the housing section, with the edges being injection molded directly onto the synthetic material of the housing section in such a way that the synthetic material of the pressure member and the synthetic material of the housing section are fused together.

9 Claims, 1 Drawing Sheet

HOUSING SECTION FOR AN ELECTRIC CIRCUIT TO BE PROTECTED FROM HARMFUL SUBSTANCES, E.G. A MOTOR VEHICLE LOCKING SYSTEM, AND PROCESS FOR PRODUCING A HOUSING WITH THE HOUSING SECTION

CROSS-REFERENCE TO RELATED APPLICATION

This application is a continuation of International Application Serial No. PCT/DE92/00681, filed Aug. 13, 1992.

BACKGROUND OF THE INVENTION

Field of the Invention

The invention relates to a housing having a housing section made of hard thermoplastic synthetic material for an electrical circuit, e.g. a motor vehicle locking system, to be protected from harmful substances, with at least one pressure member being accessible from outside the housing and with each pressure member serving to operate at least one electrical switch disposed or to be disposed inside the housing.

Although the invention was first developed for keys on a hand transmitter of a remote-controllable motor vehicle locking system, the new development of the keys in a motor vehicle on-board computer was also considered. The invention is also especially suitable for those two applications. However, it was finally found that the invention is also suitable for many other applications, especially for those in which it is important to achieve a reliable tightness against harmful substances or pollutants which can be easily and economically achieved, especially in mass production, for the keys of housings which contain circuits.

A main problem with the housing of such circuits is often the sensitivity of their electronic components to environmental effects, especially to moisture or water, but also to soiling. The tightness between the keys and the housing is critical, among other factors, because harmful substances can penetrate through gaps between the keys and the adjacent housing section.

Such keys generally contain a touch member or pressure member which serves to actuate a switch controlling the circuit, especially when the switch contains metal contacts. In principle, the invention may also relate to other kinds of switches which are to be operated through the touch member or pressure member. For the sake of simplicity, only "pressure members" will be referred to below, although the pressure necessary for operation may in principle be small enough for "touch members" to be referred to.

Many measures are known for avoiding any damaging environmental effects.

For example, the pressure members may be made of a soft flexible material, such as rubber, silicone or TPE, and then adhesively bonded at their edges or at peripheral, laterally upstanding collars or flanges to the hard housing in a watertight manner and are often additionally firmly clamped peripherally by webs, clips, tabs and the like in order to achieve the desired tightness. Sometimes the outer surface of the edge of the pressure member is additionally given a complicated notched or grooved shape and then the pressure member is pressed into the hole of the housing section in such a manner that the complicatedly shaped edge is pressed against the periphery of the housing section at the hole in order to achieve similar effects to labyrinth seals.

Sometimes, however, the pressure members are made of hard material, thus dispensing with the water-tightness between the key member and the housing. Instead of that, a space is formed under the pressure members and often also under the switches. The space is unprotected against the harmful substances and then in turn has a wall with a sealing diaphragm as sealing means for the electronics in the interior of the housing.

However, all of those known solutions are relatively complex and often unsatisfactory regarding their long-term reliability.

It is also known per se that soft thermoplastics which have been welded to hard thermoplastics or have been pressed onto one another in the liquid or doughy state readily adhere to one another after cooling, even though they are two different kinds of materials with different properties.

SUMMARY OF THE INVENTION

It is accordingly an object of the invention to provide a housing section for an electric circuit, e.g. a motor vehicle locking system, to be protected from harmful substances or pollutants, and a process for producing a housing with the housing section, which overcome the hereinafore-mentioned disadvantages of the heretofore-known devices and methods of this general type and which achieve a reliable tightness between the housing and its keys with particularly little outlay.

With the foregoing and other objects in view there is provided, in accordance with the invention, a housing for an electrical circuit, e.g. a motor vehicle locking system, to be protected from harmful substances, comprising a housing section being formed of hard thermoplastic synthetic material and having a hole formed therein; and at least one pressure member each having edges, being formed of soft thermoplastic synthetic material and being accessible from outside the housing for operating at least one electrical switch to be disposed inside the housing, the edges of the pressure member forming an all-round water-tight and adhesive-free cover for the hole in the housing section, with the edges being directly injection molded onto the synthetic material of the housing section and the synthetic material of the pressure member and the synthetic material of the housing section being fused together.

In accordance with another feature of the invention, the housing section has an inner surface, and the edges lie against the inner surface. This provides a special ruggedness against unintended damage to the fusion joint between the edge and the housing section.

In accordance with a further feature of the invention, the pressure member has an inner surface and a conductive coating being disposed more or less in the center of the inner surface and operating as a contact surface of the switch to be disposed inside the housing. This provides the possibility of also producing the switch with especially little outlay.

In accordance with an added feature of the invention, the pressure member is formed of conductive material and operates as a contact surface of the switch to be disposed inside the housing. This embodiment provides the possibility of producing the switch with very particularly little outlay at least as long as the contact gap of the switch does not have especially small values in the through-connected state.

In accordance with an additional feature of the invention, the pressure member has a protrusion or enlargement being disposed approximately in the center of the inner surface and facing the switch to be disposed inside the housing. This provides the possibility of correspondingly enlarging the distance between the outer surface of the pressure member and the contact gap of the switch, and therefore often also the distance between the outer surface of the pressure member and a printed circuit which can be mounted in the housing interior as a support for the circuit.

In accordance with yet another feature of the invention, there is provided a circuit in the form of a moisture-sensitive hand transmitter of a remote-controlled motor vehicle locking system to be activated by the pressure member. In accordance with yet a further feature of the invention, there is provided a circuit in the form of moisture-sensitive electronics of a motor vehicle on-board computer to be activated by the pressure member. In these two applications in which the final user is often accustomed to especially high demands, these provisions provide the required long-term reliability despite a low outlay.

In order to provide for mass production, with the objects of the invention in view, there is also provided a process for producing the housing which comprises holding the housing section with a holding member while injecting the pressure member with an injection molding machine.

In accordance with another mode of the invention, there is provided a process which comprises holding the housing section, as a prefabricated element, with the holding member.

In accordance with a concomitant mode of the invention, there is provided a process which comprises simultaneously producing the housing section and the pressure member by injection molding with a mold body having separate mold cavities for the housing section and for the pressure member.

Other features which are considered as characteristic for the invention are set forth in the appended claims.

Although the invention is illustrated and described herein as embodied in a housing section for an electric circuit to be protected from harmful substances or pollutants, e.g. a motor vehicle locking system, and a process for producing a housing with the housing section, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
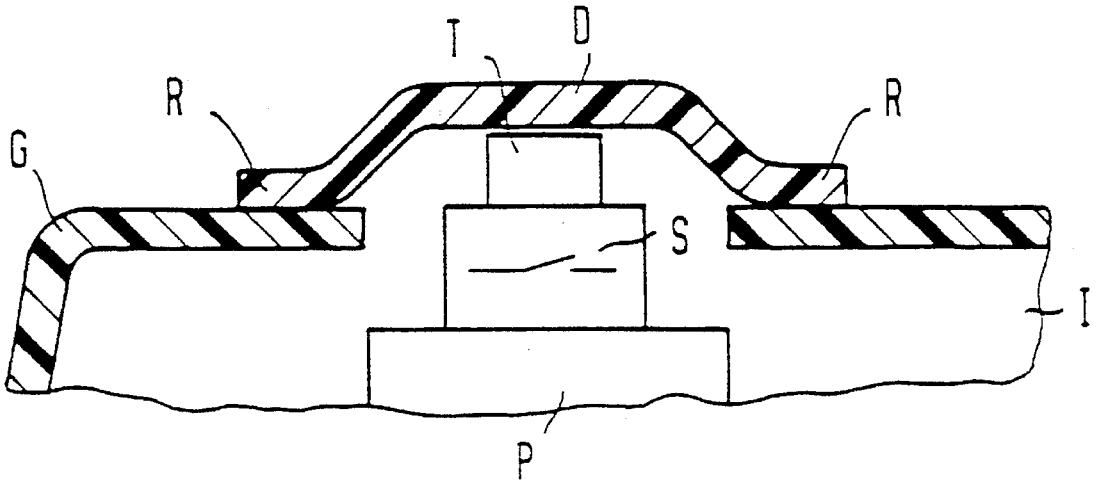
FIGS. 1 and 2 are fragmentary, diagrammatic, sectional views which illustrate exemplary embodiments of the invention as simply as possible.
Figure 2:
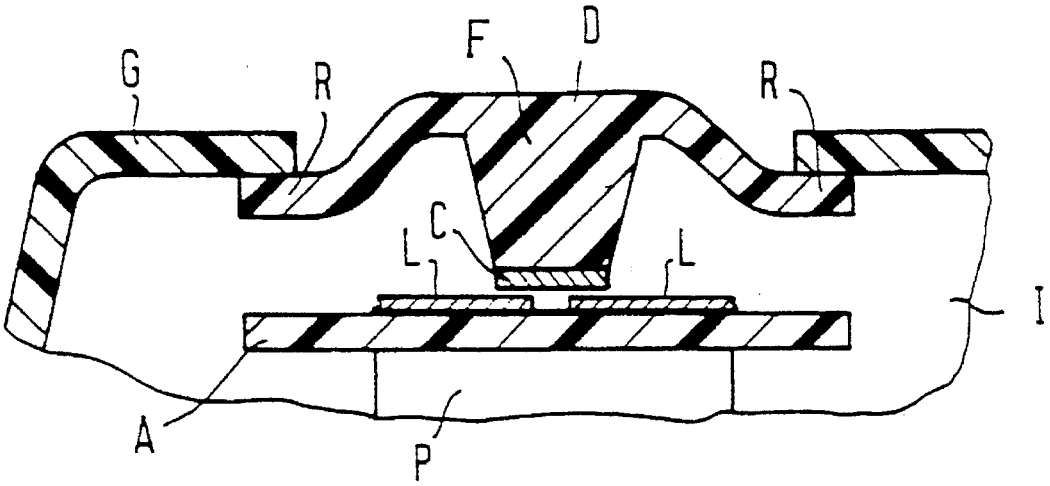

Referring now to FIGS. 1 and 2 of the drawing in detail, it is seen that the two figures each show a section of a housing G which is made of hard thermoplastic or is formed at least inter alia with the aid of hard thermoplastic and has a hole formed therein. The housing G may, for example, be the housing of known an infrared-based or radio-based hand transmitter of a remote-controllable motor vehicle central locking system.

A pressure member D, which is made of flexible thermoplastic and is accessible from outside the housing G, is attached to the illustrated housing section G and covers the hole. This pressure member D serves for the operation of an electrical switch which is already mounted at an interior I of the housing or is to be mounted subsequently. In the illustrated example only a single switch is shown. For example, a switch S which additionally contains a key member T is shown in FIG. 1, and a switch C/L is shown in FIG. 2. The switch C/L includes a conductive coating C which is suspended from a projection or an enlargement F that in turn forms a section of the pressure member D on an inner surface of the pressure member, and is formed of soft thermoplastic. The switch C/L also includes end sections of conductors L on a circuit board A which is mounted in the interior I of the housing G. The pressure member D and the switch S or C/L together form a key.

However, the invention includes a pressure member D as shown which enables the operation of not only a single switch but of a plurality of switches S or C/L.

In order to durably protect an electrical circuit to be mounted in the housing, for instance the housing G, against harmful substances or pollutants, for example against moisture, according to the invention edges R of the pressure member D provide an all-round watertight and adhesive-free cover for a hole introduced into the housing section G for operation of the switch. This is achieved by injection molding the edges R directly onto the plastic of the housing section G in such a manner that the soft thermoplastic of the pressure member D and the hard thermoplastic of the housing section G are directly fused to one another in a watertight manner at their contacting boundary surfaces. This injection molding which is performed, for example, by means of an injection molding machine, obtains the reliable tightness between the housing G and its keys D/S or D/C/L, with particularly little outlay and especially without adhesive being required therefor between the boundary surfaces. The principle according to the invention is suitable especially for the mass production of such housings G.

The hardness of the plastic of the housing not only provides the housing G with its required stiffness and strength in the case of a hand transmitter of a motor vehicle locking system, for example a motor vehicle central locking system, when the housing G has particularly water-sensitive or moisture-sensitive electronic transmitter components, such as a diagrammatically illustrated processor P, in its interior I, wherein the key structure D/S or D/C/L containing the switch then serves to control the transmitter. Additionally, the hardness of the plastic of the housing also provides the housing G with stiffness and strength, that is often greatly desired, when the housing G contains other circuits, such as the on-board computer of the motor vehicle which, among other elements, is moisture-sensitive, or if the housing G also contains any other portable or fixed circuits.

If, as in FIG. 1, the edges R of the pressure member D are attached to the outer surface of the housing section G, a good ruggedness of the joint between the plastics of the housing section G and the pressure member D can already be achieved. If, however, the finished construction of the elements G and D is subsequently particularly heavily mechanically stressed, for example if the structure forms part of the hand transmitter of the motor vehicle locking system and can be scratched at the edge R, for example by a bunch of keys in a motorist's pocket, the ruggedness against unintentional damage to the fusion joint of the edge R with the housing section G can be further increased by injection molding the pressure member D onto the housing section G in such a manner that the edges R lie against the inner surface of the housing section G, as is FIG. 2.

In order to also be able to produce parts of the switch, such as the switch C/L in FIG. 2, together with the pressure member D with an especially low outlay, the pressure member D can have the conductive coating C as a contact surface of the switch S, at least more or less in the center of its inner surface. This coating C can be formed, for example, of metal or of a silver-containing graphite composition and can cover more or less large sections of the inner surface of the pressure member D. This coating C is disposed at a location such that when the final user presses the pressure member D, the two conductors L which, for example according to FIG. 2, are mounted on a circuit board A, are bridged by the conductive coating C and a contact gap of this switch C/L thus becomes conductive.

In order to be able to produce the switch C/L of FIG. 2 together with the pressure member D with a very particularly low outlay, at least as long as the contact gap of the switch C/L does not need to have especially low values in the through-connected state, the pressure member D can be made of a soft thermoplastic which is intrinsically adequately electrically conductive or has been made sufficiently electrically conductive by additives. In this case no conductive coating C as in FIG. 2 need be applied.

In order to be able to correspondingly increase the distance between the outer surface of the pressure member D on one hand and the switch C/L or S on the other hand, the pressure member D can have the projection or enlargement F which faces the switch C/L, S as in FIG. 2, more or less in the center of its inner surface. A separate additional distance member or key member T as is used in FIG. 1, can thus often be dispensed with. The distance between the outer surface of the pressure member D and the circuit board A which can be mounted in the interior I the housing as a support for the circuit, such as element P, can thus often be correspondingly enlarged.

There are two applications in which the invention can be used to particular advantage. In both cases the final user, who is often accustomed to particularly high demands, requires long-term reliability very much as a matter of course. According to the invention, this requirement can be met with little outlay especially if the circuit, such as the element P, which is mounted in the housing G, is the electronics in the moisture-sensitive hand transmitter of a remote-controlled motor vehicle locking system, which can be activated by the pressure member D, or if this circuit P mounted in the housing G is the especially moisture-sensitive electronics of a motor vehicle on-board computer.

In order to produce the invention by mass production, the housing section G can be held by a holding member corresponding to the shape of the housing G at the moment at which the pressure member D is injection molded-on by an injection molding machine. The housing section G can be held, for example as a prefabricated element, by the holding member. However, the housing section G and the pressure member D, for example, can also be produced by means of a mold body having a separate mold cavity for the housing section G and for the pressure member D in each case, by more or less simultaneous injection molding of both parts G and D. The mold cavity intended for the housing section G is then, so to speak, simultaneously the holding member for this housing section G.

The invention thus has the advantage of permitting a wide variety of processes to be used for its production, so that the production can accordingly be easily adapted to the respective conditions prevailing in workshops.

We claim:

1. A housing for an electrical circuit to be protected from harmful substances, comprising:

a housing section being formed of hard thermoplastic synthetic material and having a hole formed therein; and at least one pressure member having edges, being formed of soft thermoplastic synthetic material and being accessible from outside the housing for operating at least one electrical switch to be disposed inside the housing, said edges of said pressure member forming an all-round water-tight and adhesive-free cover for said hole in said housing section, with said edges being directly injection molded onto the synthetic material of said housing section and the synthetic material of said pressure member and the synthetic material of said housing section being fused together, such that said housing section and said at least one pressure member together form a one-piece portion of the housing.

2. The housing according to claim 1, wherein said housing section has an inner surface, and said edges are fused with said inner surface.

3. The housing according to claim 1, wherein said pressure member has an inner surface defining a center, and a conductive coating disposed approximately in the center of said inner surface and being adapted to operate as a contact surface of the switch to be disposed inside the housing.

4. The housing according to claim 3, wherein said pressure member has a protrusion disposed approximately centrally of said inner surface and adapted to face the switch to be disposed inside the housing.

5. The housing according to claim 1, wherein said pressure member is formed of conductive material and is adapted to operate as a contact surface of the switch to be disposed inside the housing.

6. The housing according to claim 5, wherein said pressure member has an inner surface with a center, and said pressure member has a protrusion disposed approximately in the center of said inner surface and adapted to face the switch to be disposed inside the housing.

7. The housing according to claim 1, including a circuit in the form of a moisture-sensitive hand transmitter of a remote-controlled motor vehicle locking system to be activated by said pressure member.

8. The housing according to claim 1, including a circuit in the form of moisture-sensitive electronics of a motor vehicle on-board computer to be activated by said pressure member.

9. The housing according to claim 1, wherein said housing section has an outer surface, and said edges are fused with said outer surface.

* * * * *